US005150004A

United States Patent [19]

Tong et al.

[11] Patent Number: 5,150,004

[45] Date of Patent: Sep. 22, 1992

[54] CATHODE RAY TUBE ANTIGLARE COATING

[75] Inventors: Hua Sou Tong, Mundelein; Gregory Prando, Chicago, both of Ill.

[73] Assignee: Zenith Electronics Corporation, Glenview, Ill.

[21] Appl. No.: 602,522

[22] Filed: Oct. 27, 1990

Related U.S. Application Data

[63] Continuation-in-part of Ser. No. 558,993, Jul. 27, 1990, abandoned.

[51] Int. Cl.[5] ..... H01J 31/00; H01J 29/88

[52] U.S. Cl. ..... 313/479; 313/478; 358/252; 427/68

[58] Field of Search ..... 313/478, 479; 358/245, 358/246, 247, 255, 252; 174/35 MS, 35 TS; 427/68

[56] References Cited

U.S. PATENT DOCUMENTS

| | | | |
|---|---|---|---|
| 3,689,312 | 9/1972 | Long et al. | 427/68 |
| 4,563,612 | 1/1986 | Deal et al. | 313/478 |
| 4,582,761 | 4/1986 | Liu | 427/68 |
| 4,785,217 | 11/1988 | Matsuda et al. | 313/479 |
| 4,945,282 | 7/1990 | Kawamura et al. | 313/479 |
| 4,965,096 | 10/1990 | Deal et al. | 313/479 |

*Primary Examiner*—Donald J. Yusko
*Assistant Examiner*—Diab Hamadi

[57] ABSTRACT

A cathode ray tube (CRT) having a surface with reduced gloss and reflectivity and a method for providing such reduced gloss and reflectivity. In the method of the invention, a solution of a silane and a saturated hydrocarbon in a solvent system of an alcohol and water is provided. The solution is applied to the surface of a cathode ray tube to impart antiglare properties to the surface. Thereafter, the CRT with the silane applied is cured at an elevated temperature for a period of time sufficient to cause the silane to react and be converted to siloxane.

49 Claims, 10 Drawing Sheets

CATHODE RAY TUBE ANTIGLARE COATING

RELATED APPLICATIONS

The present application is a continuation-in-part of United States patent application Ser. No. 558,993, filed on Jul. 27, 1990 and now abandoned.

FIELD OF THE INVENTION

The present invention relates generally to a cathode ray tube (CRT) having a coating on the face panel thereof which provides antiglare and antistatic properties. More particularly, the present invention relates to a method for providing an antiglare and antistatic coating on the face panel of CRT's.

BACKGROUND OF THE INVENTION

Cathode ray tubes are increasingly being used as visual display terminals (VDTs) which are scanned at close range by the human eye. It is desirable to minimize the glare that is reflected from the glass surface of the CRT so as to enable the user to more easily read the graphics and other display characters that are shown on the screen.

Various methods are known for reducing the glare on CRT face panels. In one known method, a double layer of ultra fine metal oxide particles are applied onto the surface of the face panel. Tin oxide particles, having a diameter of about 50 nm, are suspended in a solution of ethyl silicate and ethanol. The suspension of tin oxide particles is coated by a spinner onto the exterior surface of the base plate of the CRT to produce a transparent, electro-conductive layer. The coated surface is heated after the application of the tin oxide layer for about thirty minutes at a temperature in the range of 100° C. to 200° C. Thereafter, a second layer of ultra-fine 50 nm diameter silicon oxide particles suspended in a solution of ethyl silicate and ethanol is coated onto the first layer by a spinner to produce a non-glare layer with antistatic properties. The CRT tube with the two layers of particles are again heated for about thirty minutes at temperatures in the range of 100° C. to 200° C.

U.S. Pat. No. 4,563,612 to Deal, et al. describes a cathode ray tube having an antistatic, glare-reducing coating. The coating has a rough surface which is composed essentially of a silicate material and an inorganic metallic compound The coating is applied by spraying a solution of a water soluble salt of one or more of a metal selected from platinum, tin, palladium and gold in a lithium stabilized silica sol onto the surface of the cathode ray tube. A solution of lithium, sodium and potassium silicate or an organic silicate, such as tetraethyl orthosilicate may be substituted for the lithium stabilized silica sol.

U.S. Pat. No. 4,582,761 to Liu discloses an aqueous dispersion of polyvinyl acetate for use as a coating on an electronic viewing screen to provide antiglare properties.

U.S. Pat. No. 3,689,312 to Long, et al. is directed to a method for producing a glare-reducing coating on the surface of a cathode ray tube. The method includes the steps of preparing a coating formulation consisting of a solution of a siliceous polymer and an organic polymer in a volatile organic liquid vehicle for the polymers. The solution is then sprayed onto the surface of a cathode ray tube to coat the surface. The cathode ray tube is then baked at a temperature of 100° C. to 200° C. to cure the coating.

A cathode ray tube having an antistatic film is disclosed in U.S. Pat. No. 4,785,217 to Matsuda, et al. The antistatic film is applied by dipping the cathode ray tube into a mixture of tetraethyl silicate, propanol and butanol containing a colloidal solution of metal particles.

It is known to apply a solution of tetrachlorosiliane in an anhydrous alcohol to the surface of a CRT heated to 50° C. to 80° C. to reduce glare. The tube surface is then heated to a temperature up to 200° C. for 15–20 minutes to cause polymerization of the silane to a polysiloxane. In this method, the silane solution is sprayed onto the surface of the CRT in the form of discrete island droplets of the solution. A continuous film of the solution must be avoided to provide optimum antiglare properties.

It is also known to apply coatings of lithium silicate onto the surface of a CRT to provide antiglare properties.

While various prior art methods have been proposed for reducing gloss and providing antiglare properties to the surface of a CRT, such methods have not met with complete success. It is important that any coating provided on the surface of the CRT to reduce gloss does not impart undesirable side effects, such as the provision of a mottled or uneven surface. The diffusive reflectivity of the surface imparted by the coating should also not be substantially different than that of the uncoated CRT.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENT

The invention is useful for cathode ray tubes of various types including home entertainment and medium-resolution and high-resolution types for use in color and monochrome monitors.

Figure 1:
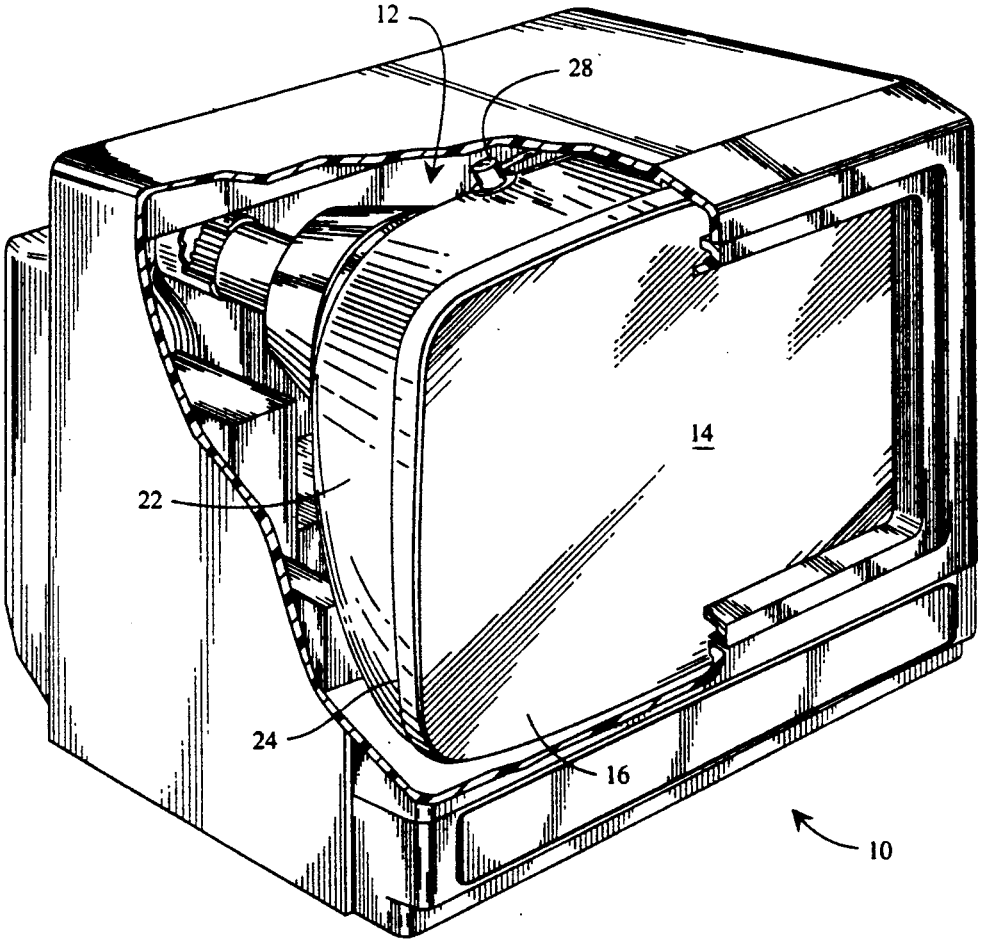
FIG. 1 is a cut-away view in perspective of a cabinet that houses a color cathode ray tube, showing certain components, including a front panel, which are the subject of the present invention.

FIG. 1 shows a novel video monitor 10 that houses a color cathode ray tube 12 having a front panel assembly according to the invention. The design of the video monitor is the subject of copending Design Patent application Ser. No. 725,040 of common ownership herewith. The monitor, and the associated tube according to the invention, is notable for the flat imaging area 14 that makes possible the display of images in undistorted form. The front assembly system comprises the components described in the following paragraphs.

A funnel 22 is shown as being attached to a peripheral sealing area 24 on the inner surface of face plate 16. A high electrical potential is applied through a high voltage conductor (not shown) attached to an anode button 28 which conducts the potential (the source of which is a high voltage power supply) through the wall of the funnel 22. The potential may be in the range of 18 to 32 kilovolts, by way of example.

Figure 2:
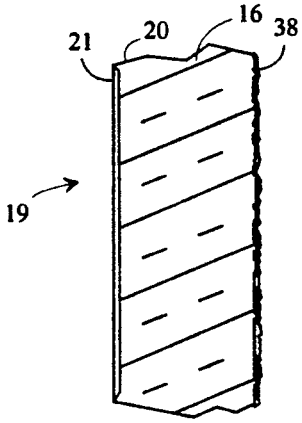
FIG. 2 is a cross-sectional view, broken away, of the front panel of the cathode ray tube of FIG. 1.
Figure 8:
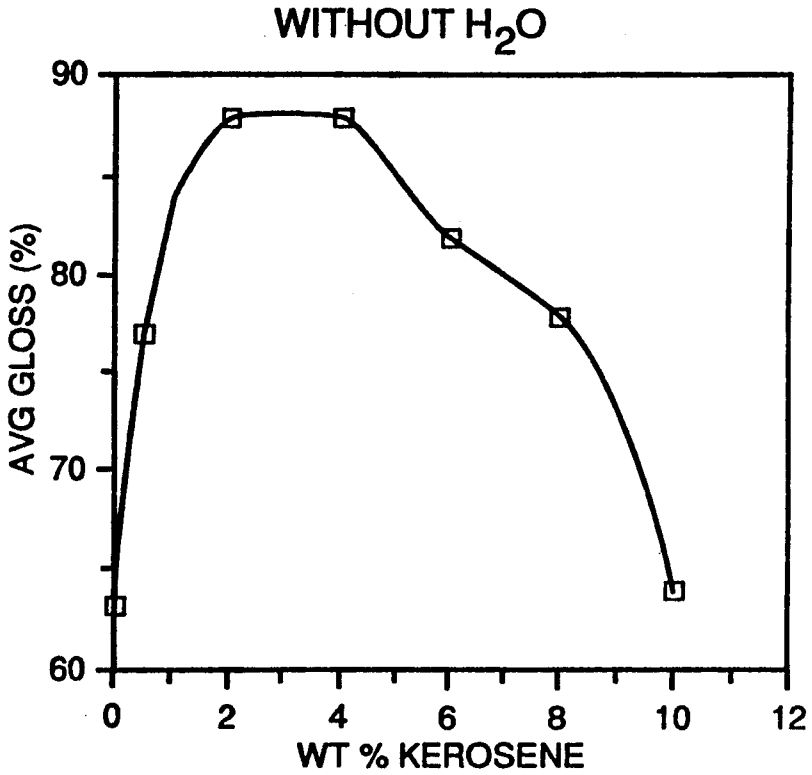
FIG. 8 is a plot of the gloss level of the surface of a cathode ray tube treated with a coating composition containing tetrachlorosilane and various levels of kerosene and no water.

With reference also to FIG. 2, the imaging area 14 includes a glass face panel 16 that may be flat, or alternatively, "substantially flat" in that it may have finite horizontal or vertical radii, by way of example. Face panel 16 is represented as having on its inner surface a centrally disposed electron beam target area 19 on which is disposed at least one pattern of phosphor deposits 20. An electrically conductive screen 21 is depicted schematically as being deposited on and overlaying the pattern of phosphor deposits 20. The electrically conductive screen 21 comprises a film of highly reflective, electrically conductive aluminum disposed on the pattern of phosphor deposites 20 by evaporative means or by hot stamping and having a thickness of about 2000 Angstroms. The novel antiglare-antistatic coating 38 of the invention is depicted as having a rippled, textured surface coating of a mixture of saturated hydrocarbon and siloxane.

Generally, in accordance with the present invention, a solution of a silane and saturated hydrocarbon in a solvent system comprising an alcohol and water is applied to the surface of a cathode ray tube (CRT) to impart antiglare properties to the surface of the CRT. The CRT with the silane and hydrocarbons applied is then cured at an elevated temperature to cause the silane to react in the environment of the solution and to be converted to an adhering coating of a mixture of hydrocarbons and siloxane.

The saturated hydrocarbons useful in the compositions of the present invention are selected from saturated paraffinic, straight chain hydrocarbons of the formula $C_nH_{2n+2}$ and saturated napthenic, cyclic hydrocarbons of the formula $C_nH_{2n}$ and mixtures thereof where n is an integer from 8 to 16. For reasons of cost and availability, a preferred saturated hydrocarbon is selected from kerosene and jet fuel which are products obtained from the refining of crude oil. Kerosene and jet fuel are primarily a mixture of $C_{10}$–$C_{14}$ paraffinic and napthenic components.

Figure 3:
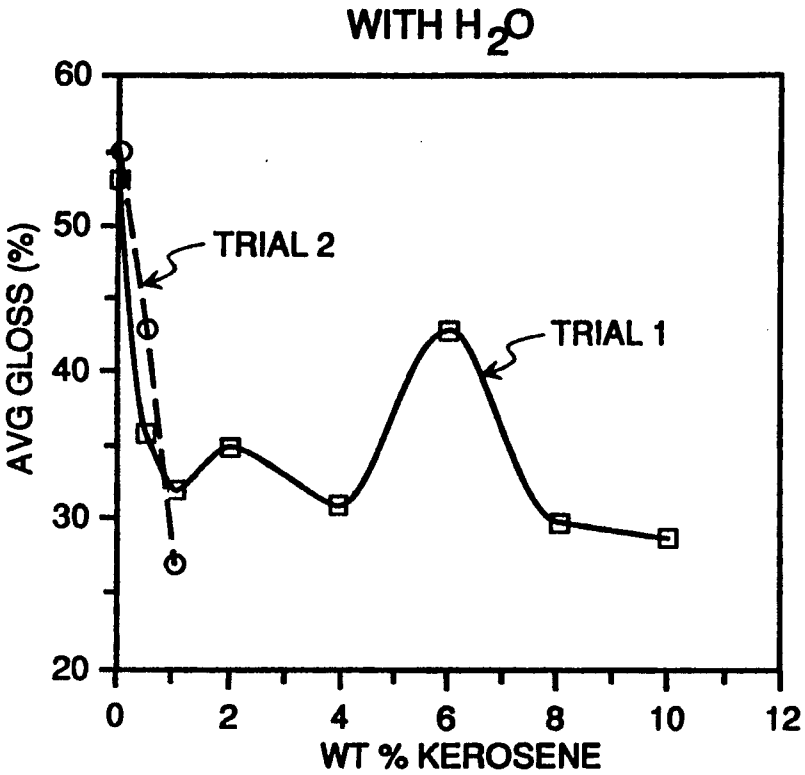
FIG. 3 is a plot of the gloss level of the surface of a cathode ray tube treated with an antiglare composition of the present invention containing tetrachlorosilane, water and various levels of kerosene.

The saturated hydrocarbons are present in the coating compositions of the present invention at a level of from about 0.1% to about 10%. The use of saturated hydrocarbons provides a noticeable effect on the reduction of gloss at very low levels, as can be seen in FIG. 3. FIG. 3 was prepared from the data generated in EXAMPLE 1 which is discussed hereinbelow. A preferred level of use of the saturated hydrocarbons is from about 0.2% to about 1%. At levels above about 1%, a milky appearance begins to form on the surface of the cathode ray tube. While further levels of gloss reduction can be obtained at saturated hydrocarbon levels above 1%, the reflectance profile and physical appearance may not be suitable.

It is a surprising aspect of the present invention that the coating compositions of the invention containing a silane and saturated hydrocarbons also impart antistatic properties. None of the components of the coating composition have heretofore been associated with producing antistatic features when applied to the surface of a cathode ray tube. In accordance with the present invention, the coating compositions of the invention provide a coating with antistatic properties capable of reducing a surface voltage of 25 Kv to 1 Kv in less than about 50 seconds.

Figure 11:
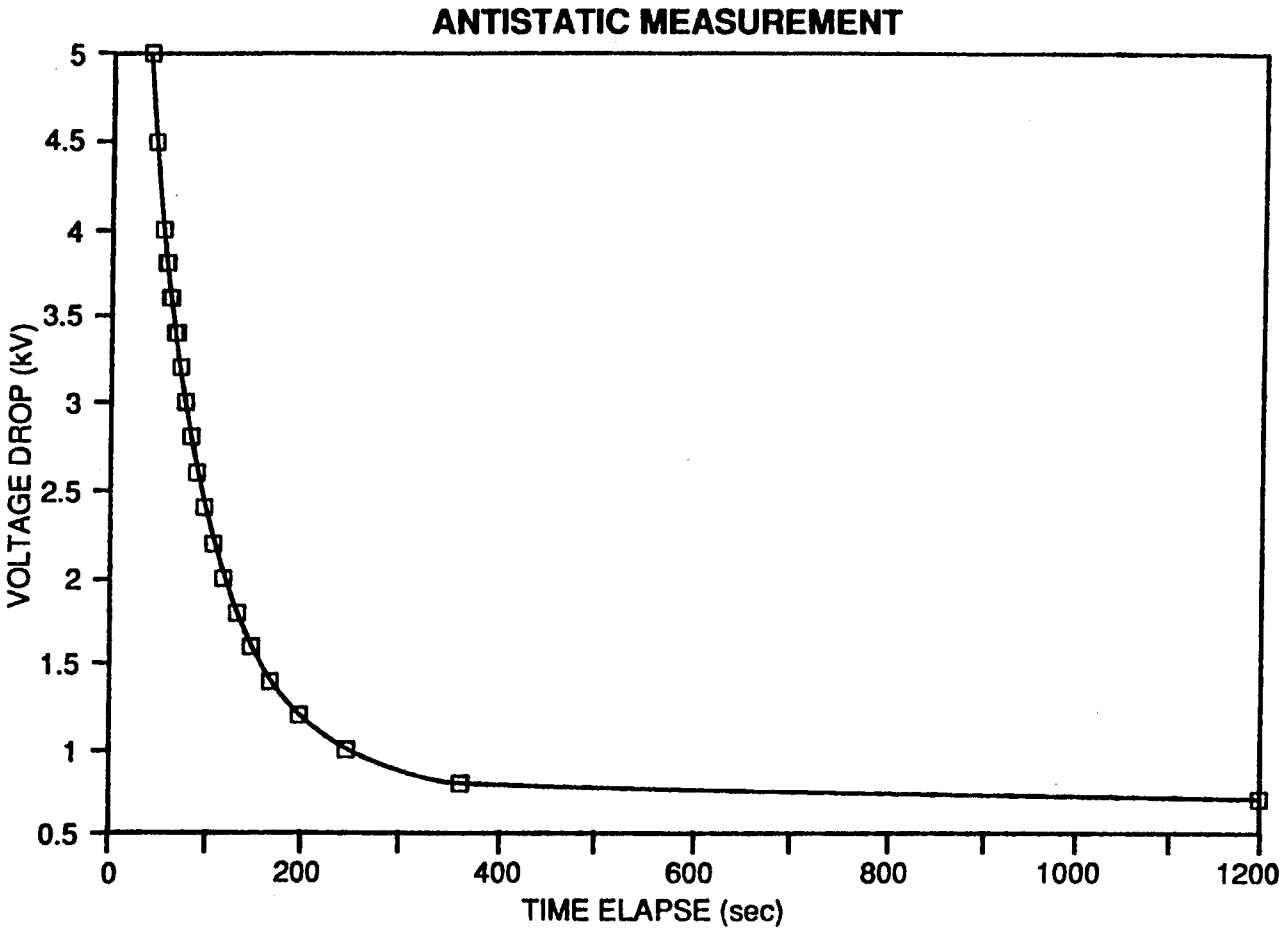
FIG. 11 is a plot of the antistatic properties of a commercial cathode ray tube having a prior art coating.
Figure 12:
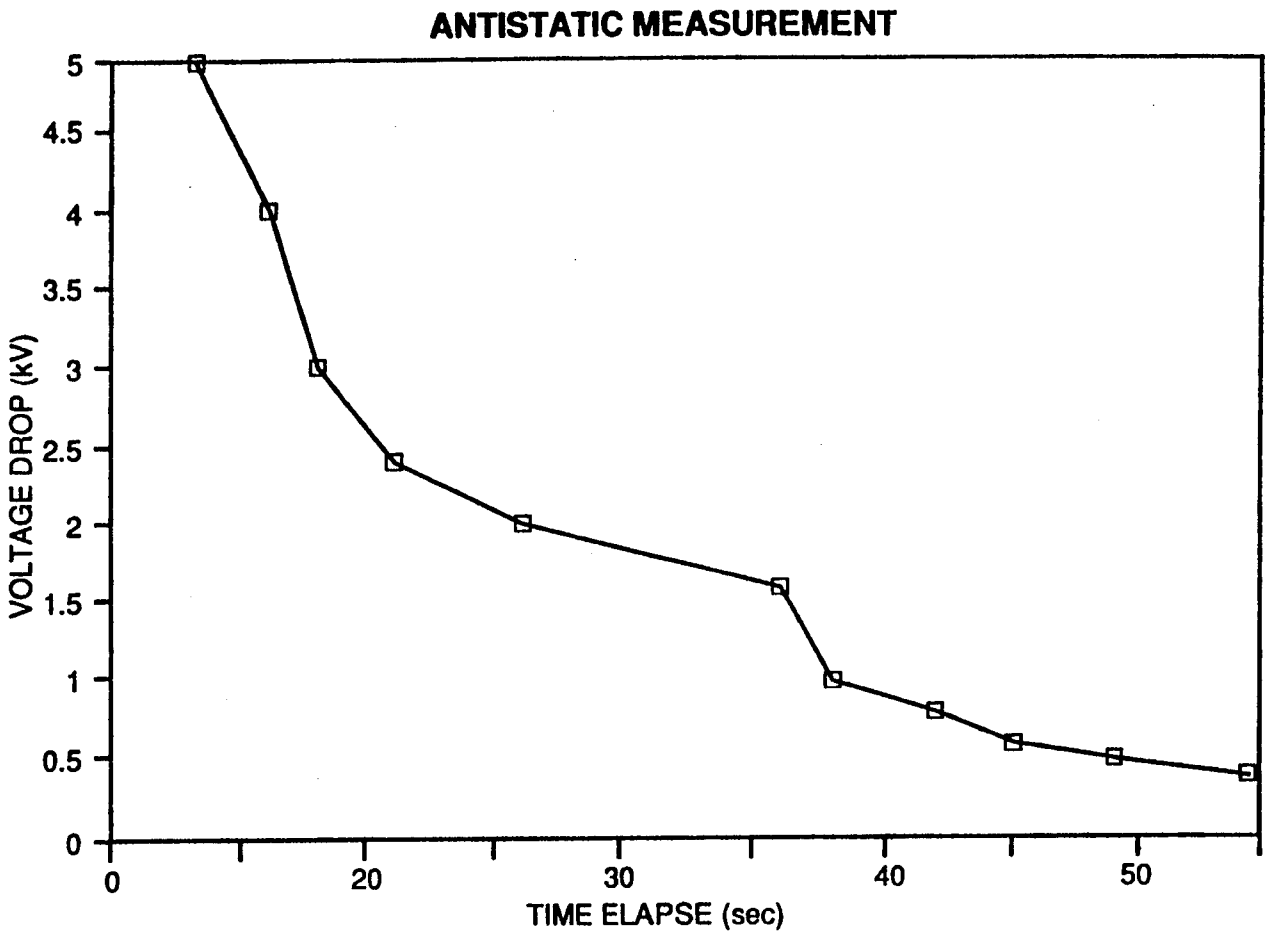
FIG. 12 is a plot of the antistatic properties of a cathode ray tube having a coating of the composition of the present invention.

As shown in FIG. 12, an actual plot of antistatic measurements for a cathode ray tub coated with the coating composition of the invention containing 3% tetrachlorosilane, 10% water and 1% kerosene in ethyl alcohol, shows a reduction surface voltage from 25 Kv to 1 Kv in 38 seconds. In contrast, as shown in FIG. 11, the plot of antistatic measurements of a commercial cathode ray tube having a prior art coating shows that it takes 200 seconds to reduce the surface voltage from 25 Kv to 1 Kv.

The surface of the CRT is first cleaned with a suitable cleaning agent. Suitable cleaning agents include commercial glass detergent, such as 409 TM, manufactured by The Clorox Co. and Windex TM, manufactured by Drackett Products Co. In one embodiment of the invention, a two-step cleaning process is used to assure adherence of the silane solution. In the first step, the surface of the CRT is rubbed with a suitable particulate substance having a fine particle size in the range of from about 3 to about 12 microns. Suitable particulate substances are metal oxides such as cerium oxide or alumina; volcanic glasses, such as pumice; and friable silicon materials, such as a rottenstone. The CRT is then rinsed with water. In the second step, the CRT is cleaned by the application of a commercial glass detergent and is again rinsed with water. The CRT is then dried in air, preferably by the use of compressed air.

Any commercially available silane, which is soluble in the solvent system of the invention, may be used in the method of the present invention. The silane preferably has a boiling point of less than about 60° C. and is preferably selected from the group consisting of tetraalkoxysilanes, tetraaryloxysilanes and halogenated silanes. Suitable silanes include tetrachlorosilane (TCS), tetramethoxysilane (TMS), tetraethoxysilane (TES) and triochlorosilane (TRCS). The silane is preferably present in the solution at a level of from about 0.5 percent to about 50 percent by weight, based on the weight of the solvent.

The solvent system of the present invention for halogenated silanes is an aliphatic $C_1$–$C_4$ alcohol containing a predetermined amount of saturated hydrocarbons and water. Preferred alcohols are selected from the group consisting of ethanol, propanol and butanol. A particularly preferred alcohol is ethanol.

The amount of water in the solvent system is preferably from about 5% to about 45%. While the water can be present in the solvent system for halogenated silanes at a level of up to about 45%, best results in terms of solution stability, gloss reduction and diffusive reflectance are obtained when the water is present at a level of from about 5% to about 25%. All percentages used herein are by weight, unless otherwise indicated.

The solvent system for alkoxy silanes and aryloxy silanes can have higher levels of water. The alkoxy an aryloxy moieties of the silane compounds hydrolyze in water having an acidic pH of from about 2 to about 6 to provide an alcohol formed in situ. Accordingly, water which has been acidified with a non-oxidizing acid to a pH of from about 2 to about 6, can be used as the sole solvent. Thus, for alkoxy and aryloxy silanes, the solvent system is water which contains from 0% to 95% of an aliphatic $C_1$–$C_4$ alcohol. It should be noted, however, that as the level of water is increased, the stability of the solution decreases and storage for periods longer than about 8 hours may become a problem for solvent systems containing more than about 90% water.

Figure 9A:
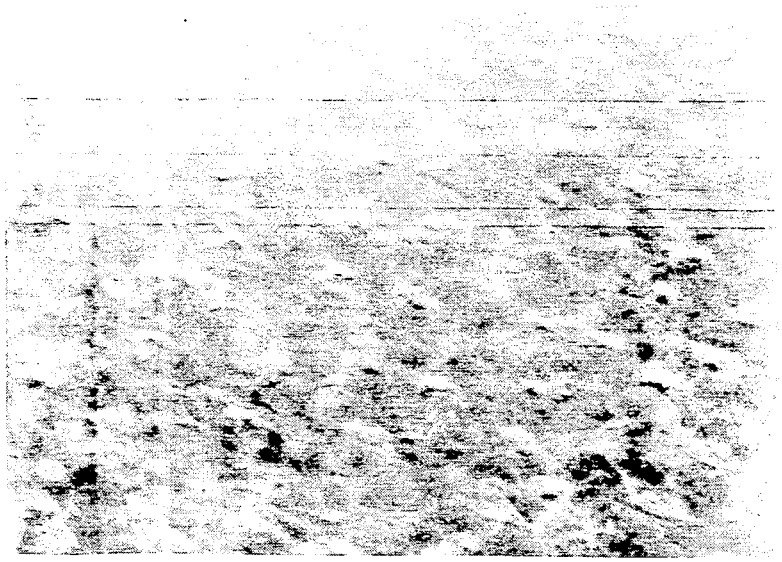
FIGS. 9A through 9C are photomicrographs (500×) of the surface of a cathode ray tube treated with a coating composition containing tetrachlorosilane and various levels of kerosene and no water.
Figure 9B:
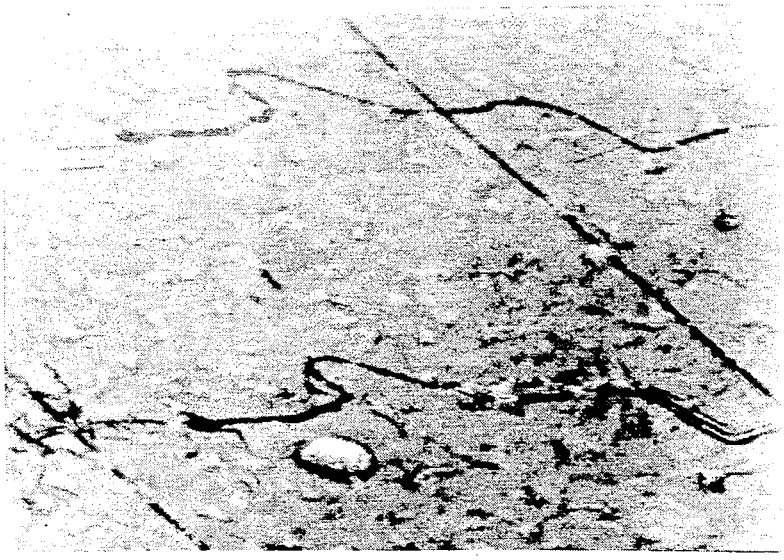
Figure 9C:
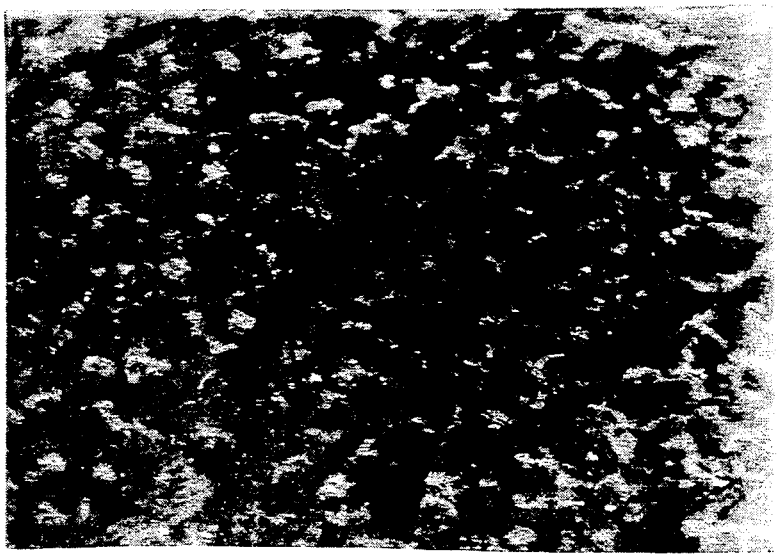

The importance of the use of water in the compositions of the invention is illustrated in FIG. 9. The compositions of FIG. 9 do not contain water and the gloss level increased as the level of saturated hydrocarbon is increased up to about 6%.

The silane and saturated hydrocarbon solution is applied to the surface of the cathode ray tube by spraying a fine mist of the solution onto the surface. The surface of the cathode ray tube is preheated prior to the application of the solution to initiate the chemical reaction, which will form particles of silane and saturated hydrocarbon on the surface of the panels. The preheated surface also helps to evaporate the alcohol and water and prevent running of the solution. The surface of the cathode ray tube is preferably preheated to a temperature of from about 90° C. to about 120° C. The fine mist of the solution is applied so as to form a plurality of discrete droplets uniformly over the surface of the CRT.

In the method of the invention, it is important that the solution drops which are sprayed onto the surface of the CRT have a particle size in the range of from about 0.3 to about 0.5 microns at the point of arrival at the surface of the CRT. The desired solution drop size can be attained by use of a compressed air spray gun having a fluid nozzle orifice of from about 0.05 to about 0.13 mm and which is operated at an air pressure of 30–60 psig, a fluid pressure of 5–15 psig and a distance of spray gun to CRT surface of 25–35 cm. The solution is preferably applied to the surface of the cathode ray tube at a level sufficient to provide from about 0.3 to about 1.2 milligrams of the silane per square centimeter of the surface area. In this connection, the presence of water and saturated hydrocarbon in the solution results in a beneficial effect on both gloss reduction and diffusive reflectance. This effect is most significant for saturated hydrocarbon levels up to about 1% and for water levels ranging up to 10%. Further gloss reduction is obtained at saturated hydrocarbon levels above 1% and water levels up to about 25% but to a lesser extent. Saturated hydrocarbon levels above about 10% and water levels higher than about 25% can be used, but no further significant decrease in gloss reduction is attained. For mixtures of saturated hydrocarbons and alkoxy or aryloxy silanes, however, the diffusive reflectance is further improved at high levels of water above 45%. Water can be used as the sole solvent for such alkoxy or aryloxy and saturated hydrocarbon mixtures.

A single pass of a spray gun over the surface of the front panel of the cathode ray tube may not result in the application of the desired amount of the solution of the silane. The solution may be applied in multiple layers such as by repeatedly passing a spray gun over the surface of the cathode ray tube. The cathode ray tube is preferably preheated to a temperature in the range of from about 90° C. to about 120° C. prior to the first spray pass and the remaining spray passes are made prior to any substantial cooling of the surface. In an important embodiment of the invention, from about 3 to about 12 spray passes of the solution are applied.

After the solution of the silane is applied, the cathode ray tube may be cured at an elevated temperature for a period of time sufficient to convert the silane to siloxane. Suitable temperature and time conditions are a temperature of from about 120° C. to about 200° C. for a period of from about 0.1 hour to about 2 hours Curing at an elevated temperature is not essential and curing may be effected at ambient temperature.

Figure 10:
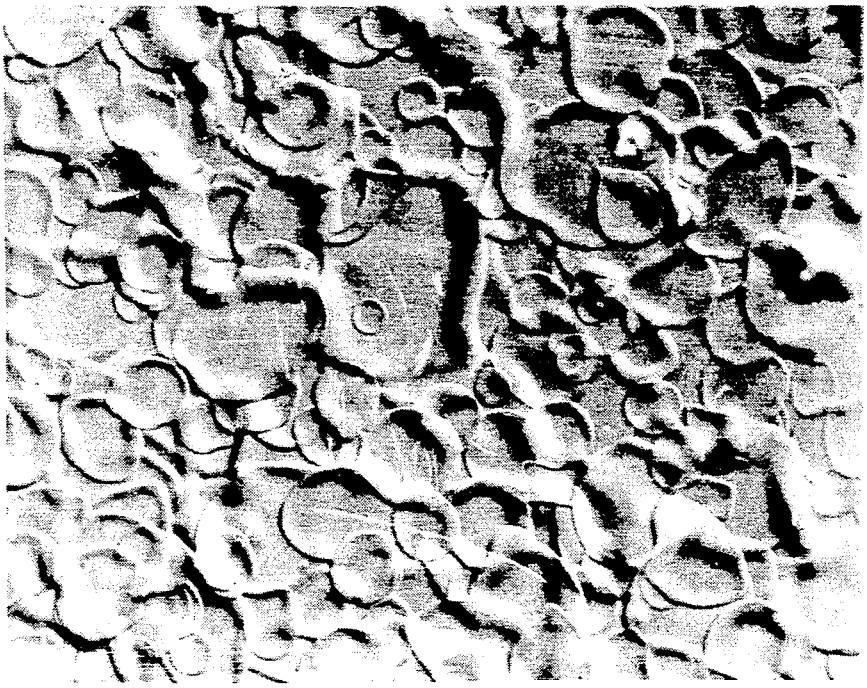
FIG. 10 is a photomicrograph (500x) of a prior art antiglare coating.

It is not known whether the saturated hydrocarbon remains with the silane as part of the coating or whether it is evaporated during the curing step. However, the use of saturated hydrocarbon in the compositions of the present invention provide a unique surface topology which is believed to be highly beneficial in providing the reduced gloss on cathode ray tubes coated with composition. While not wishing to be bound by a theory, it is believed that the presence of the saturated hydrocarbon alters the surface tension of the droplets applied to the surface of the cathode ray tube. This alteration is believed to be influential in providing the ability to apply the coating composition uniformly on the surface and to provide a distinctive and unique surface topology which, as shown in FIGS. 7(*b*) and 7(*c*), is in the form of a random distribution of uniform undulations which is of a uniform texture which is substantially devoid of craters or other circular formations which are suggestive of droplet splattering. The surface topology of a cathode ray tube having a prior art coating (FIG. 10) shows substantial cratering indicative of high amounts of splattering.

After curing with a silane coating, the CRT has a gloss of less than about 45%. For reference purposes, an uncoated CRT has a gloss of about 92% and a mirror would have a gloss of 100%.

The following examples further illustrate various features of the present invention, but are intended to in no way limit the scope of the invention which is defined in the appended claims.

EXAMPLE 1

Two series of solutions of a silane as set forth in Table I was prepared having the following components at the indicated levels

TABLE 1

| Component | Trial 1 Weight Percent | Trial 2 Weight Percent |
|---|---|---|
| Ethanol | 77–87 | 77–87 |
| Tetrachlorosilane (TCS) | 3 | 3 |
| Water | 10 | 0 |
| Kerosene | 0–10 | 0–10 |

A CRT was cleaned by buffing with a buffing compound, which is a uniform paste having 1 part by weight of cerium oxide having a particle size in the range of 3 to 12 microns, 1 part by weight of Syloid 244 (Davidson), 1 part by weight mineral spirits, 1 part by weight methylene chloride and 1 part by weight xylene. This is followed by rinsing with tap water, cleaning with a commercial glass detergent (Windex TM manufactured by the Drackett Products Co., Cincinnati, Ohio), rinsing again with tap water and drying by directing a stream of compressed air over the surface of the CRT.

Silane solutions having various levels of kerosene were sprayed onto the panel surface of eight cleaned cathode ray tubes which had been preheated to a temperature of 90° C. The solvent and water were flashed from the surface of the face panel to provide a coating of silane. Spraying was accomplished by use of a compressed air spray gun having a nozzle orifice of 0.07 cm, and operated at an air pressure of 50 psig and a fluid pressure of 10 psig. The spray gun was moved back and forth over the surface of the CRT from a distance of 30 cm. Five passes of the spray gun were used to deposit a coating of 0.5 mg of silane per $cm^2$ of surface area. The cathode ray tube was then cured at a temperature of 120° C. for a period of fifteen minutes. The resulting coating was a thin layer of a mixture of silicon oxide and saturated hydrocarbons. The average gloss reduction of the face panel without kerosene in the coating composition was 53%. The results of the average gloss reduction for compositions containing 10% water at various levels of kerosene is set forth below in Table 2.

TABLE 2

| TRIAL 1 | TCS - Kerosene - 10% Water Results | | | | | | | |
|---|---|---|---|---|---|---|---|---|
| | WT % KEROSENE | | | | | | | |
| Gloss | 0 | 0.5 | 1 | 2 | 4 | 6 | 8 | 10 |
| Avg. Gloss of 8 CRT Tubes | 53 | 36 | 32 | 35 | 31 | 43 | 30 | 29 |
| Max Value | 65 | 48 | 40 | 42 | 41 | 58 | 45 | 36 |
| Min Value | 42 | 24 | 22 | 26 | 22 | 32 | 15 | 20 |

The results for the average gloss reduction for the compositions containing no water and various levels of kerosene are set forth in Table 3.

TABLE 3

| TRIAL 2 | TCS - Kerosene - 0% Water Analysis Results | | | | | | | |
|---|---|---|---|---|---|---|---|---|
| | WT % KEROSENE | | | | | | | |
| Gloss | 0 | 0.5 | 1 | 2 | 4 | 6 | 8 | 10 |
| Avg. Gloss of 8 CRT Tubes | 63 | 77 | 84 | 88 | 88 | 82 | 78 | 64 |
| Max Value | 87 | 93 | 90 | 92 | 91 | 87 | 86 | 79 |

TABLE 3-continued

| TRIAL 2 | TCS - Kerosene - 0% Water Analysis Results | | | | | | | |
|---|---|---|---|---|---|---|---|---|
| | WT % KEROSENE | | | | | | | |
| Gloss | 0 | 0.5 | 1 | 2 | 4 | 6 | 8 | 10 |
| Min Value | 39 | 47 | 71 | 82 | 86 | 76 | 62 | 47 |

The data from Table 2 is plotted in FIG. 3. The data from Table 3 is plotted in FIG. 9.

Figure 4:
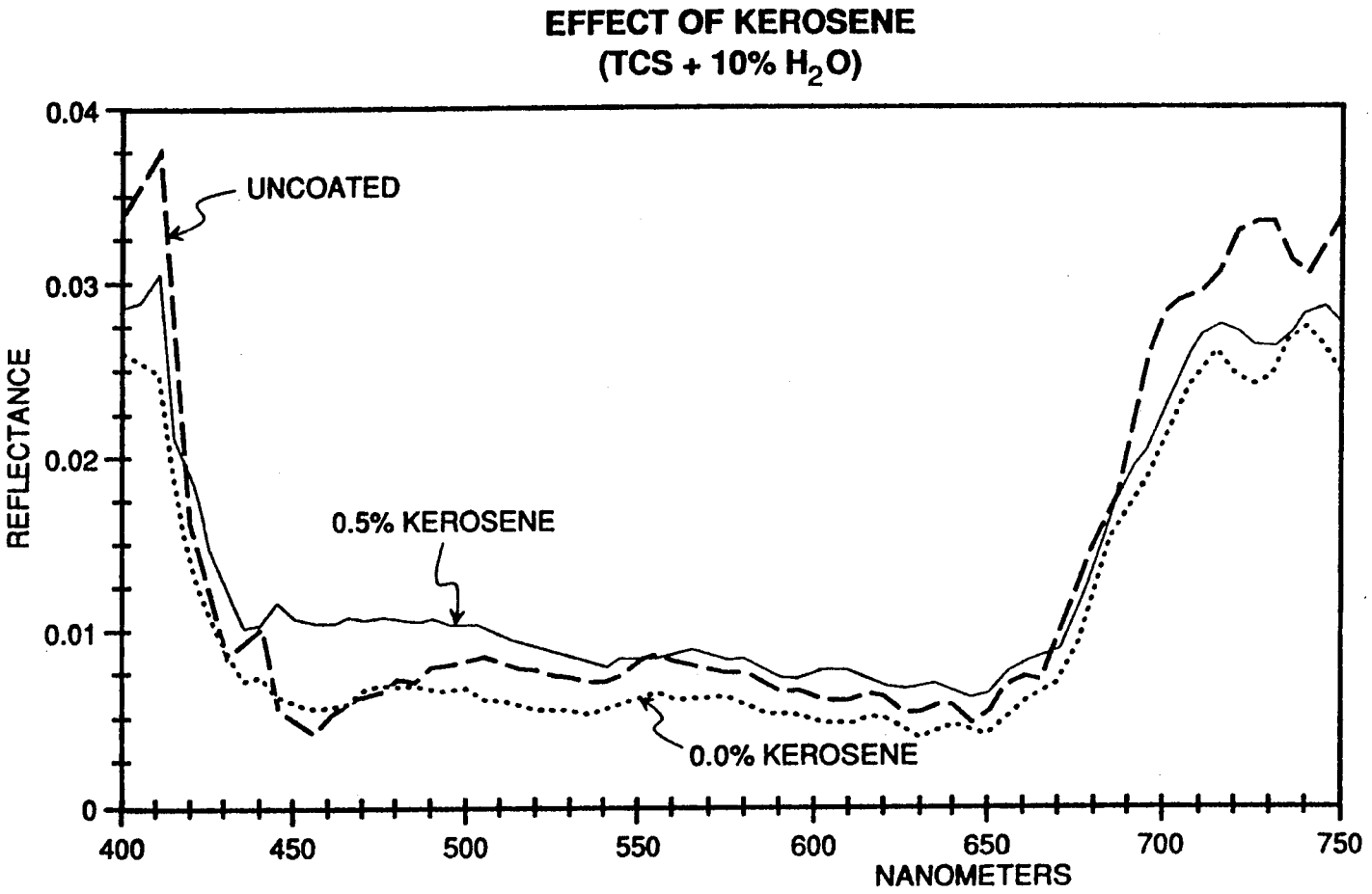
FIG. 4 is a plot of the diffusive reflectance of the surface of a cathode ray tube at various wave lengths, wherein the cathode ray tube has been treated with an antiglare composition of the present invention containing tetrachlorosilane, 0.5% kerosene and 10% water, is uncoated and is coated with a composition containing trichlorosilane and 10% water.
Figure 5:
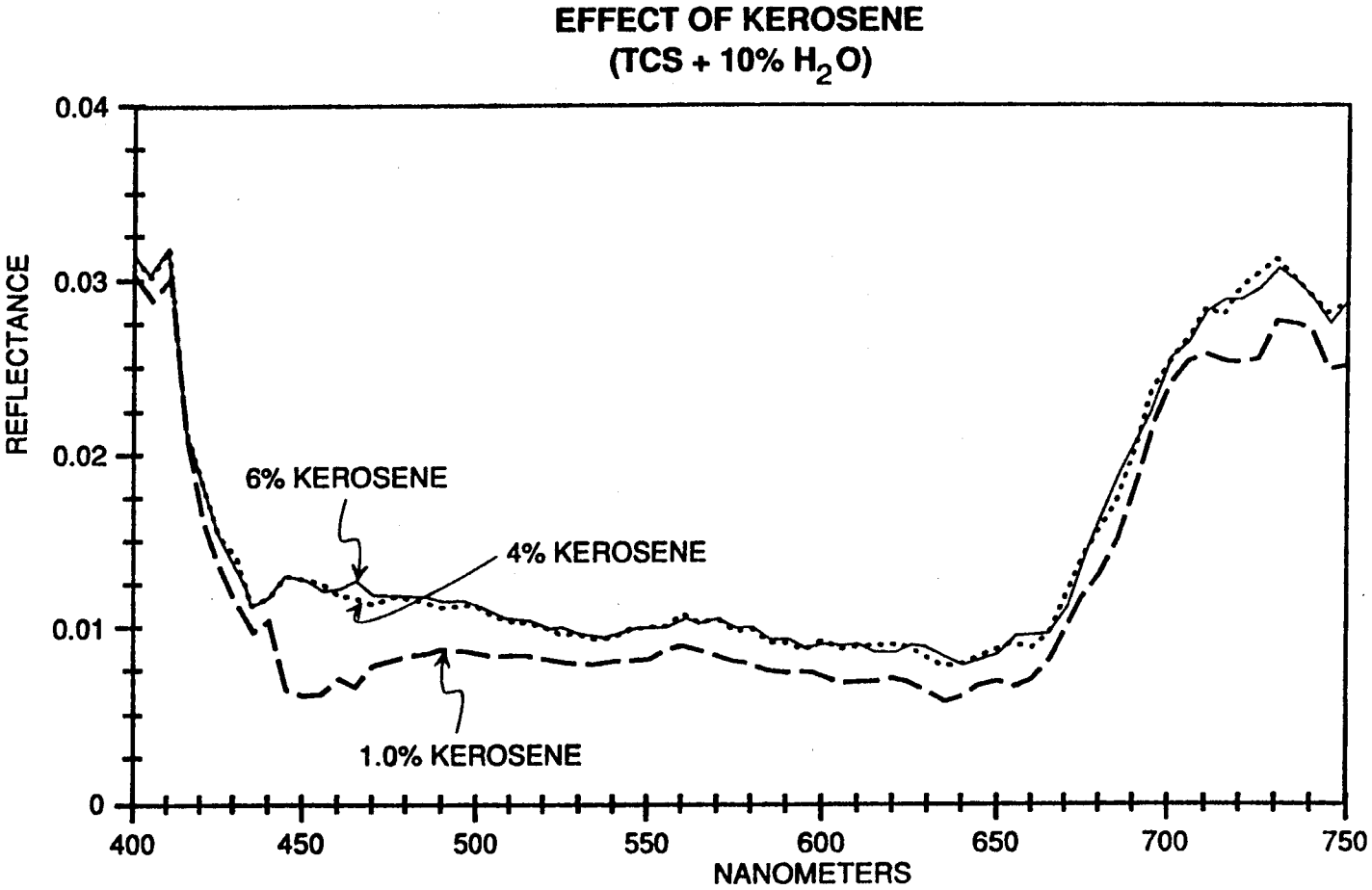
FIG. 5 a plot of the diffusive reflectance of the surface of a cathode ray tube at various wave lengths utilizing the coating composition of the present invention containing tetrachlorosilane, 10% water and various levels of ketosene.
Figure 6:
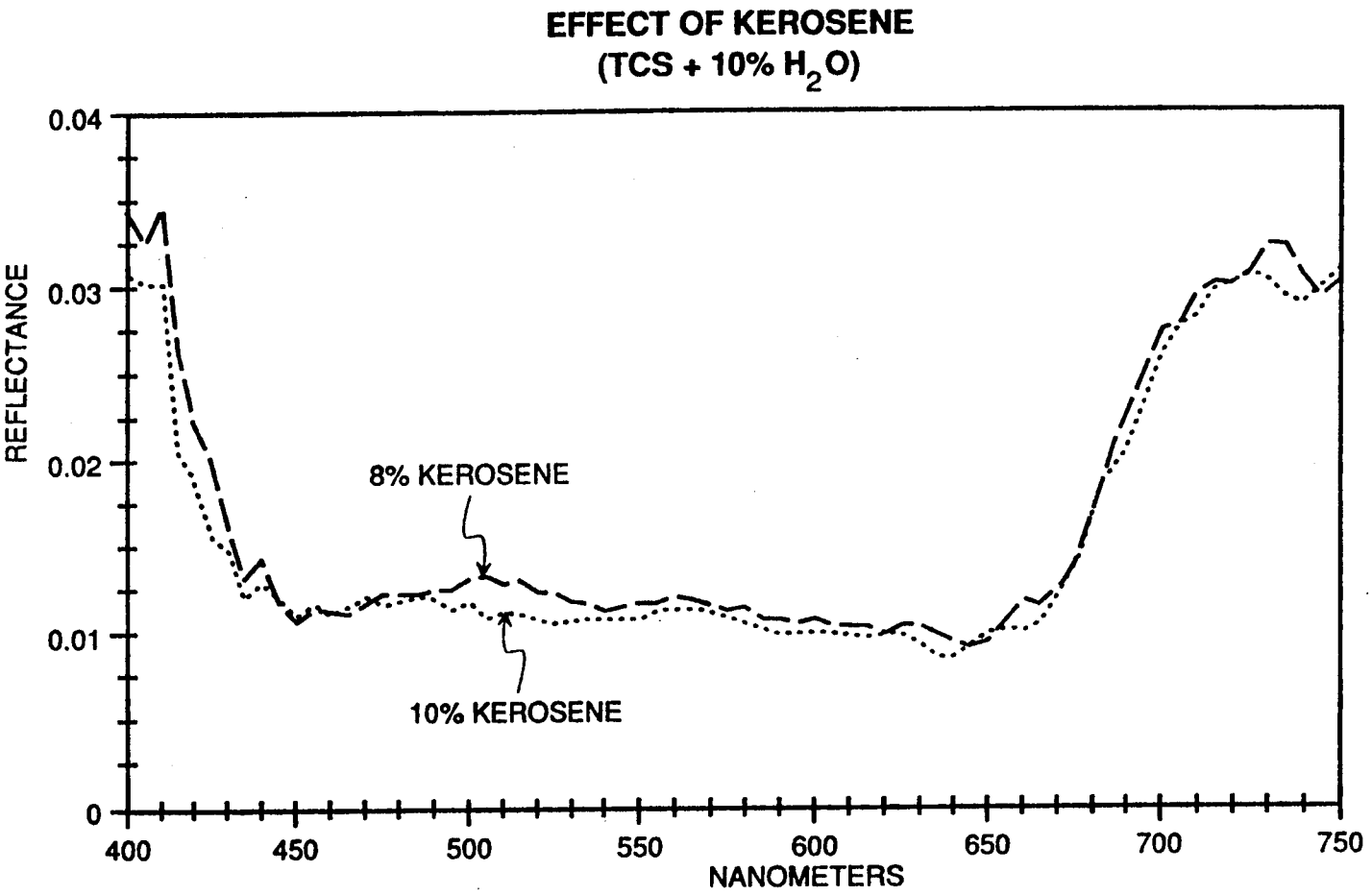
FIG. 6 is a plot of the diffusive reflectance of a cathode ray tube at various wave lengths utilizing a coating composition of the present invention containing tetrachlorosilane and various levels of water.

Another important aspect of a CRT is the diffusive reflectance of the CRT surface. The diffusive reflectance preferably remains substantially similar to those of an uncoated CRT in the wavelength span of from 400 to 750 nanometers (nm). As shown in FIGS. 4, 5 and 6, the use of 3% tetrachlorosilane and various levels of kerosene in anhydrous alcohol with 10 % water produces a diffusive reflectance curve which is only slightly displaced (higher) from that of an uncoated CRT.

Figure 7A:
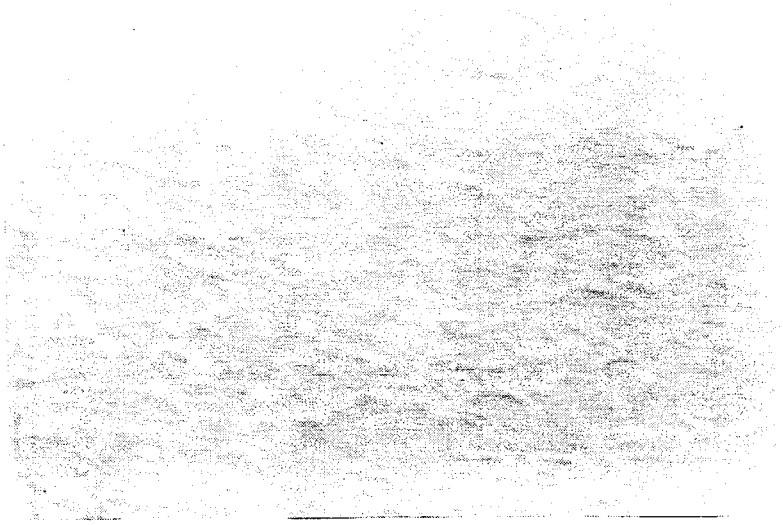
FIGS. 7A through 7C are photomicrographs (500×) of the surface of a cathode ray tube treated with a coating composition containing tetrachlorosilane, water and various levels of kerosene.
Figure 7B:
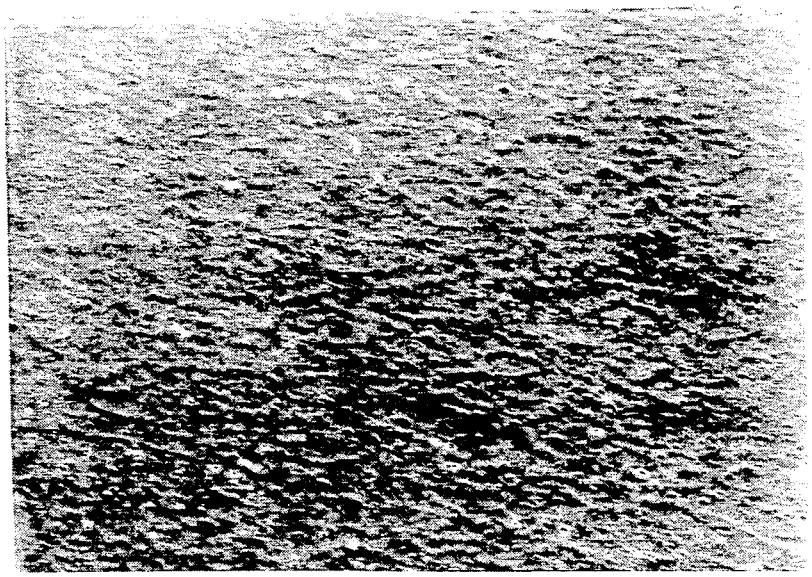
Figure 7C:
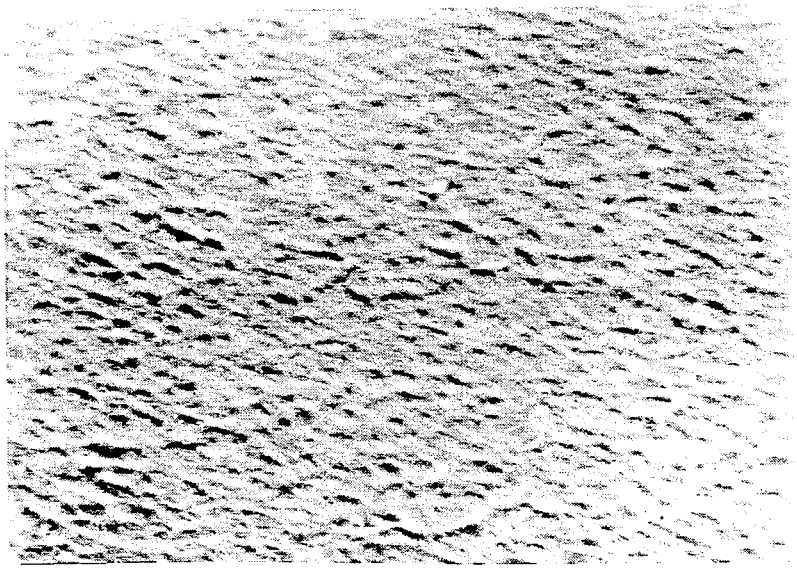

Further important properties for coatings on the surface of a CRT are the texture and roughness. As shown in FIG. 7A, a coating composition containing no kerosene provides a mottled, reasonably uniform surface. The surface of a CRT coated with 3% tetrachlorosilane, 0.5% or 1% kerosene in alcohol containing 10% water (FIGS. 7B and 7C) displays a more uniform textured surface. The surface of the CRT shown in FIG. 7C has a highly desirable random distribution of substantially uniform undulations The prior art antiglare coating of FIG. 10, has a cratered surface with a substantial proportion of the surface being undesirably flat.

Tetrachlorosilane coatings of the invention having 3% tetrachlorosilane in anhydrous ethyl alcohol (no water and no kerosene) (FIG. 9A) display a splotchy, non-uniform surface. The use of kerosene without water (FIGS. 9B and 9C) do not provide a noticeably improved surface. The results shown in FIG. 3 (reduction in gloss) compared to FIG. 9 (no reduction in gloss) and the difference in surface appearance, (compare FIGS. 7A–7C with FIGS. 9A–9C) demonstrate the synergistic effect of the use of a combination of water and saturated hydrocarbons in the compositions of the invention.

EXAMPLE 2

A CRT was coated in accordance with the procedure of Example 1 with a silane solution having 3% tetrachlorosilane, 1% kerosene, 10% water and 86% ethyl alcohol. The antistatic properties of this CRT tube was determined by measuring the elapsed time to reduce tho surface charge from 25 Kv to less than 1 Kv. The antistatic properties of a prior art CRT having a coating of palladium chloride particles deposited from a lithium silicate dispersion and a CRT having a first coating of tin oxide and a second coating of silicon oxide were also measured int he same way. The results are set forth in Table 4.

TABLE 4

| | COATING | | |
|---|---|---|---|
| Voltage Kv | Silane | $PdCl_2$ Time - Seconds | $TiO_2/SiO_2$ |
| 5 | 13 | 40 | |
| 4 | 16 | 55 | 10 |
| 3 | 18 | 77 | |
| 2 | 26 | 115 | |
| 1 | 38 | 244 | 25 |
| 0.5 | 48 | >1200 | 30 |

It can be seen that the coating of the present invention provides comparable antistatic properties to the complex two step double coating process utilizing tin oxide and silicon oxide and is far superior by an order of magnitude to the palladium chloride method. This is a surprising and unexpected result since neither the silane nor the kerosene would be expected to provide antistatic properties.

While various features of the present invention have been described with respect to particular embodiments, it is readily apparent to one skilled in the art that numerous variations and modifications may be made without departing from the scope of the invention as set forth in the appended claims.

What is claimed is:

1. A CRT having a surface with reduced gloss comprising a CRT having a coating on the surface thereof, said coating being provided by applying fine droplets of a solution of a silane and a saturated hydrocarbon selected from the group consisting of saturated straight chain paraffinic hydrocarbons having the formula $C_nH_{2n+2}$ and saturated cyclic napthenic hydrocarbons having the formula $C_nH_{2n}$ in a solvent system comprising an alcohol and water onto the surface of said CRT and curing the silane and saturated hydrocarbon for a period of time sufficient to convert said silane to a siloxane being in the form of a random distribution of substantially uniform undulations.

2. A CRT in accordance with claim 1 wherein n is an integer of from 8 to 16.

3. A CRT in accordance with claim 1 wherein said saturated hydrocarbon is selected from kerosene, jet fuel and mixtures thereof.

4. A CRT in accordance with claim 1 wherein said silane is present on the surface of said cathode ray tube at a level of from about 0.3 to about 1.2 milligrams per square centimeter of said surface area of said cathode ray tube.

5. A CRT in accordance with claim 1 wherein said solution is applied by spraying a fine mist of said solution onto said surface.

6. A CRT in accordance with claim 1 wherein said silane is present in said solution at a level of from about 0.5 percent to about 50 percent, based on the weight of said solution.

7. A CRT in accordance with claim 1 wherein said alcohol is propanol.

8. A CRT in accordance with claim 1 wherein said solution droplets have a diameter of from about 0.3 to about 0.5 microns.

9. A CRT in accordance with claim 1 wherein said silane is an alkoxy or aryloxy silane which is present in said solution at a level of from about 0.5% to about 50%, said saturated hydrocarbon is present in said solution at a level of from about 0.1% to about 10%, said alcohol is present in said solution at a level of from 0% to about 95% and said water is present in said solution at a level of from 5% to 100%.

10. A CRT in accordance with claim 1 wherein said surface of said cathode ray tube is preheated prior to application of said solution.

11. A CRT in accordance with claim 1 wherein said cathode ray tube is preheated to a temperature in the range of from about 70° C. to about 120° C. prior to applying said solution.

12. A CRT in accordance with claim 1 wherein said silane is present on the surface of said cathode ray tube at a level of from about 0.3 to about 1.2 milligrams per square centimeter of said surface area of said cathode ray tube.

13. A CRT in accordance with claim 1 wherein said solution is applied to said surface of said cathode ray tube by multiple spray passes.

14. A CRT in accordance with claim 13 wherein from 3 to 12 spray passes are used to apply said solution.

15. A CRT in accordance with claim 1 wherein said alcohol is a $C_1$–$C_4$ aliphatic alcohol.

16. A CRT in accordance with claim 15 wherein said alcohol is ethanol.

17. A CRT in accordance with claim 1 wherein said saturated hydrocarbon is present in said solution at a level of from about 0.1% to about 10%.

18. A CRT in accordance with claim 17 wherein said saturated hydrocarbon is present in said solution at a level of from about 0.2% to about 1%.

19. A CRT in accordance with claim 1 wherein said silane is selected from the group consisting of tetraalkoxy silanes, tetraaryloxy silanes and halogenated silanes.

20. A CRT in accordance with claim 19 wherein said silane is selected from the group consisting of tetrachlorosilane, trichlorosilane, tetramethoxysilane and tetraethoxysilane.

21. A CRT in accordance with claim 20 wherein said silane is a halogenated silane which is present in said solution at a level of from about 0.5 to about 50%, said saturated hydrocarbon is present in said solution at a level of from about 0.1% to about 10%, said alcohol is present in said solution at a level of from about 55% to about 95% and water is present in said solution at a level of from about 5% to about 45%.

22. In a cathode ray tube, a front panel having on a first surface an antiglare, antistatic coating resulting from application of a solution of a silane and a saturated hydrocarbon selected from the group consisting of saturated straight chain paraffinic hydrocarbons having the formula $C_nH_{2n+2}$ and saturated cyclic napthenic hydrocarbons having the formula $C_nH_{2n}$ in a solvent system comprising alcohol and water, said coating having a distinctive topography of a random distribution of substantially uniform undulations which are of uniform texture and which is substantially devoid of craters or other circular formations suggestive of particle spattering.

23. A CRT in accordance with claim 22 wherein the gloss is less than about 45 percent.

24. A CRT in accordance with claim 22 wherein a 25 Kv surface charge is reduced to less than 1 Kv in less than about 50 seconds.

25. A CRT having a surface with reduced gloss comprising a CRT having a coating on the surface thereof, said coating being provided by applying fine droplets of a solution consisting essentially of a silane and a saturated hydrocarbon in a solvent system comprising an alcohol and water onto the surface of said CRT and curing the silane and saturated hydrocarbon for a period of time sufficient to convert said silane to a siloxane coating on the surface of said cathode ray tube.

26. A CRT in accordance with claim 25 wherein said saturated hydrocarbon is selected from kerosene, jet fuel and mixtures thereof.

27. A CRT in accordance with claim 25 wherein said silane is present on the surface of said cathode ray tube at a level of from about 0.3 to about 1.2 milligrams per square centimeter of said surface area of said cathode ray tube.

28. A CRT in accordance with claim 25 wherein said solution is applied by spraying a fine mist of said solution onto said surface.

29. A CRT in accordance with claim 25 wherein said silane is present in said solution at a level of from about 0.5 percent to about 50 percent, based on the weight of said solution.

30. A CRT in accordance with claim 25 wherein said alcohol is propanol.

31. A CRT in accordance with claim 25 wherein said solution droplets have a diameter of from about 0.3 to about 0.5 microns.

32. A CRT in accordance with claim 25 wherein said silane is an alkoxy or aryloxy silane which is present in said solution at a level of from about 0.5% to about 50%, said saturated hydrocarbon is present in said solution at a level of from about 0.1% to about 10%, said alcohol is present in said solution at a level of from 0% to about 95% and said water is present in said solution at a level of from 5% to 100%.

33. A CRT in accordance with claim 25 wherein said saturated hydrocarbon is present in said solution at a level of from about 0.1% to about 10%.

34. A CRT in accordance with claim 33 wherein said saturated hydrocarbon is present in said solution at a level of from about 0.2% to about 1%.

35. A CRT in accordance with claim 25 wherein said saturated hydrocarbon is selected from the group consisting of saturated straight chain paraffinic hydrocarbons having the formula $C_nH_{2n+2}$ and saturated cyclic napthenic hydrocarbons having the formula $C_nH_{2n}$.

36. A CRT in accordance with claim 35 wherein n is an integer of from 8 to 16.

37. A CRT in accordance with claim 25 wherein said surface of said cathode ray tube is preheated prior to application of said solution.

38. A CRT in accordance with claim 37 wherein said cathode ray tube is preheated to a temperature in the range of from about 70° C. to about 120° C. prior to applying said solution.

39. A CRT in accordance with claim 37 wherein said silane is present on the surface of said cathode ray tube at a level of from about 0.3 to about 1.2 milligrams per square centimeter of said surface area of said cathode ray tube.

40. A CRT in accordance with claim 25 wherein said solution is applied to said surface of said cathode ray tube by multiple spray passes.

41. A CRT in accordance with claim 40 wherein from 3 to 12 spray passes are used to apply said solution.

42. A CRT in accordance with claim 25 wherein said alcohol is a $C_1$–$C_4$ aliphatic alcohol.

43. A CRT in accordance with claim 42 wherein said alcohol is ethanol.

44. A CRT in accordance with claim 25 wherein said silane is selected from the group consisting of tetraalkoxy silanes, tetraaryloxy silanes and halogenated silanes.

45. A CRT in accordance with claim 44 wherein said silane is selected from the group consisting of tetrachlorosilane, trichlorosilane, tetramethoxysilane and tetraethoxysilane.

46. A CRT in accordance with claim 45 wherein said silane is a halogenated silane which is present in said solution at a level of from about 0.5 to about 50%, said saturated hydrocarbon is present in said solution at a level of from about 0.1% to about 10%, said alcohol is present in said solution at a level of from about 55% to about 95% and water is present in said solution at a level of from about 5% to about 45%.

47. In a cathode ray tube, a front panel having on first surface an antiglare, antistatic coating resulting from application of a solution consisting essentially of a silane and a saturated hydrocarbon in a solvent system comprising alcohol and water, said coating having a distinctive topography of a random distribution of substantially uniform undulations which are of uniform texture and which is substantially devoid of craters or other circular formations suggestive of particle spattering.

48. A CRT in accordance with claim 47 wherein the gloss is less than about 45 percent.

49. A CRT in accordance with claim 47 wherein a 25 Kv surface charge is reduced to less than 1 Kv in less than about 50 seconds.

* * * * *